US007458128B2

(12) United States Patent
Smith et al.

(10) Patent No.: US 7,458,128 B2
(45) **Date of Patent: *Dec. 2, 2008**

(54) CLEANING ATTACHMENT FOR CONVERTING A CLEANING IMPLEMENT TO A MOP

(75) Inventors: James A. Smith, Chatham, MA (US); Betty J. Murphy, Cedar Grove, NJ (US)

(73) Assignee: Watch Hill Harbor Technologies, Chathem, MA (US)

( * ) Notice: Subject to any disclaimer, the term of this patent is extended or adjusted under 35 U.S.C. 154(b) by 689 days.

This patent is subject to a terminal disclaimer.

(21) Appl. No.: 10/737,287

(22) Filed: Dec. 16, 2003

(65) Prior Publication Data

US 2004/0158951 A1 Aug. 19, 2004

Related U.S. Application Data

(63) Continuation-in-part of application No. 09/917,069, filed on Jul. 27, 2001, now Pat. No. 6,745,434, and a continuation-in-part of application No. 10/180,409, filed on Jun. 25, 2002, now Pat. No. 6,705,792.

(51) Int. Cl.
*A47L 13/20* (2006.01)

(52) U.S. Cl. ..... 15/247; 15/228; 15/104.94

(58) Field of Classification Search ..... 15/247, 15/104.93, 104.94, 228, 209.1, 210.1
See application file for complete search history.

(56) References Cited

U.S. PATENT DOCUMENTS

| | | | | |
|---|---|---|---|---|
| 960,158 | A | 5/1910 | Cummings et al. | |
| 1,080,572 | A | 12/1913 | McDonald | |
| 1,138,305 | A | 5/1915 | Miller | |
| 1,476,396 | A | 12/1923 | Dickson | |
| 1,929,082 | A | 10/1933 | Simon | |
| 2,221,305 | A | 11/1940 | Chase | |
| 2,269,424 | A | 1/1942 | Bernstein | |
| 2,293,461 | A | 8/1942 | Gougeon | |
| 2,382,205 | A | 8/1945 | Coats | |
| 2,446,814 | A | 8/1948 | Crofton | |
| 2,655,680 | A | 10/1953 | Geerin | |
| 2,704,375 | A * | 3/1955 | Haeusser | 15/104.94 |
| 2,709,824 | A | 6/1955 | Hall | |
| 2,733,470 | A | 2/1956 | Wilder | |
| 2,756,449 | A | 7/1956 | Dewey | |
| 2,816,313 | A | 12/1957 | Beck | |

(Continued)

FOREIGN PATENT DOCUMENTS

| | | |
|---|---|---|
| FR | 2 575 058 | 12/1985 |

*Primary Examiner*—Laura C Guidotti
(74) *Attorney, Agent, or Firm*—Connolly Bove Lodge & Hutz

(57) ABSTRACT

Various forms of cleaning attachments are described for converting a cleaning implement to a mop. In one form the attachment is a combination wipe and attachment wherein at least a portion of the attachment is made of an absorbent material so that the attachment itself can function as a wipe. In another form of the invention a wipe is detachably mounted to the cover portion of the attachment by reusable mounting structure located on at least one of the side walls of the cover. Various forms of pouches or containers are also described for containing a cleaning solution or other added ingredients which may form part of the attachment by the container of pouch being secured to the attachment.

28 Claims, 5 Drawing Sheets

U.S. PATENT DOCUMENTS

| | | | | |
|---|---|---|---|---|
| 2,858,559 | A | | 11/1958 | Carlson |
| 2,963,731 | A | | 12/1960 | Hoots |
| 2,999,265 | A | | 9/1961 | Duane |
| 3,221,356 | A | | 12/1965 | Schirmer |
| 3,299,464 | A | | 1/1967 | O'Brien |
| 3,339,220 | A | | 9/1967 | Barry |
| 3,380,504 | A | | 4/1968 | Green |
| 3,400,420 | A | | 9/1968 | Granville |
| 3,462,790 | A | | 8/1969 | Lingle |
| 3,737,938 | A | | 6/1973 | Saltzstein |
| 3,896,518 | A | | 7/1975 | Von Post |
| 3,913,164 | A | | 10/1975 | Semenchuk |
| 4,084,910 | A | | 4/1978 | LaRosa |
| 4,430,013 | A | | 2/1984 | Kaufman |
| 4,455,705 | A | | 6/1984 | Graham |
| 4,823,427 | A | | 4/1989 | Gibbs |
| 4,852,210 | A | | 8/1989 | Krajicek |
| 4,945,599 | A | | 8/1990 | Flynn |
| 5,000,602 | A | | 3/1991 | Kim |
| 5,012,544 | A | | 5/1991 | Verry |
| 5,042,105 | A | | 8/1991 | Buck |
| 5,094,559 | A | | 3/1992 | Rivera |
| 5,138,738 | A | | 8/1992 | Nicholson |
| 5,177,831 | A | | 1/1993 | Wirth |
| 5,217,787 | A | | 6/1993 | Monahan |
| 5,280,664 | A | | 1/1994 | Lin |
| 5,358,107 | A | * | 10/1994 | Laske ..... 206/361 |
| 5,419,015 | A | | 5/1995 | Garcia |
| 5,525,397 | A | | 6/1996 | Shizuno |
| 5,709,006 | A | | 1/1998 | Carter |
| 5,953,784 | A | | 9/1999 | Suzuki |
| 5,964,005 | A | | 10/1999 | Williams |
| 6,058,548 | A | | 5/2000 | Footer |
| 6,105,193 | A | | 8/2000 | Williams |
| 6,380,151 | B1 | | 4/2002 | Masters |
| 6,579,023 | B2 | | 6/2003 | Kunkler |
| 6,681,434 | B2 | * | 1/2004 | Smith ..... 15/104.93 |
| 6,701,567 | B2 | * | 3/2004 | Smith ..... 15/247 |
| 6,705,792 | B2 | * | 3/2004 | Smith ..... 401/283 |
| 6,745,434 | B2 | * | 6/2004 | Smith et al. ..... 16/247 |
| 2002/0083964 | A1 | | 7/2002 | McKay |
| 2002/0152569 | A1 | | 10/2002 | Zorzo |
| 2003/0035679 | A1 | | 2/2003 | Zorzo |
| 2003/0044569 | A1 | | 3/2003 | Kacher |
| 2003/0049407 | A1 | | 3/2003 | Kacher |
| 2003/0095826 | A1 | | 5/2003 | Policicchio |
| 2003/0110584 | A1 | | 6/2003 | Clare |

* cited by examiner

CLEANING ATTACHMENT FOR CONVERTING A CLEANING IMPLEMENT TO A MOP

CROSS REFERENCE TO RELATED APPLICATIONS

This application is a continuation-in-part of application Ser. No. 09/917,069 filed Jul. 27, 2001 now U.S. Pat. No. 6,745,434, and of Ser. No. 10/180,409 filed Jun. 25, 2002 now U.S. Pat. No. 6,705,792.

BACKGROUND OF THE INVENTION

For years now, brooms have been used for both interior and exterior floor cleaning procedures. Brooms come in all types and sizes, but the most common is the type that looks like an oversized paint brush (with corn bristles) and the long handle. In particular, the most widely used type broom today on interior floor surfaces is a plastic bristled broom having bristles cut on an angle to facilitate sufficient floor sweeping and has a long handle so the user can stand upright.

A disadvantage of brooms is that they can only sweep up dry soil of a rather large size and have no absorbative ability on dry or wet soils. Recently, new products have been introduced into the "handled goods" market. These products are essentially disposable dust mops that will absorb dust and pet hair on hard surface flooring. These new implements use disposable, dry, non-woven cloths sized approximately 10" by 12". These dry wipes are attached to a hard, flat, rectangular plastic mop head with an elongated handle. The cloths are discarded when dirty and a new one is attached. A recent variation is a wet wipe version for mopping kitchen and bathroom floors.

If one wants to damp mop or wash the floor the most common thing to do is to purchase another cleaning implement such as a "string mop" or sponge mop to be used with detergent, water and a bucket. Mopping wood flooring requires additional and different cleaning agents.

SUMMARY OF THE INVENTION

An object of this invention is to provide a simple attachment that could be used with a broom or other cleaning implement to accommodate disposable wipes for use with virtually all hard surface flooring, dusting and mopping jobs.

A further object of this invention is to provide such a cleaning attachment which can be easily applied to the broom head covering the bristles and which can readily have either a wet or dry wipe detachably mounted to the attachment.

A still further object of this invention is to provide a cleaning attachment which can be used without having a wipe detachably mounted to it.

In accordance with one embodiment of this invention a cleaning attachment for converting a cleaning implement, such as a broom, comprises a flexible cover which in its flat unassembled condition has a first end and a second end with a continuous intermediate section between the ends. One of the ends is bifurcated to create a pair of spaced outwardly extending flaps with an open area therebetween so that when the flap are connected to the other end a closed loop is formed around the cleaning head of a cleaning implement with the handle of the implement extending through the open area between the flaps. A cleaning area is on each side of the loop at the bottom of the loop. Each of the cleaning areas is made of an absorbent material so that the attachment itself can be used without requiring a wipe to be mounted to it.

In accordance with a further embodiment of this invention a cleaning attachment generally of the above described type has reusable mounting structure on at least one of its side walls and further reusable mounting structure on the outer surface of the cover so that a wipe could be detachably mounted to the attachment and be located on at least the one side wall having the reusable mounting structure.

In yet a further embodiment of the invention the cleaning attachment could have a container mounted to it for holding a cleaning solution. At least one dispensing opening is provided in the outer wall of the container spaced from the cover. Flow regulating structure is provided at the dispensing opening to selectively dispense the cleaning solution from the container.

Other practices of the invention relate to various details of the attachment such as forming the attachment to include a pair of wings at the lower end of the attachment with the wings being part of a smooth continuous curve surface. In a further variation the attachment could be of clam shell form.

THE DRAWINGS

DETAILED DESCRIPTION

The present invention relates to variations of a cleaning attachment such as described in co-pending patent applications Ser. No. 09/917,069, filed Jul. 27, 2001, Ser. No. 09/995,134, filed Nov. 27, 2001, Ser. No. 10/007,528, filed Dec. 5, 2001 and Ser. No. 10/180,409, filed Jun. 25, 2002. All of the details of these applications are incorporated herein by reference thereto. Various features disclosed in those applications and not specifically referred to in this present application may, however, be incorporated in the various embodiments disclosed herein. Similarly, features shown in one embodiment of this application may be incorporated in other embodiments within the spirit of this invention.

Figure 1:
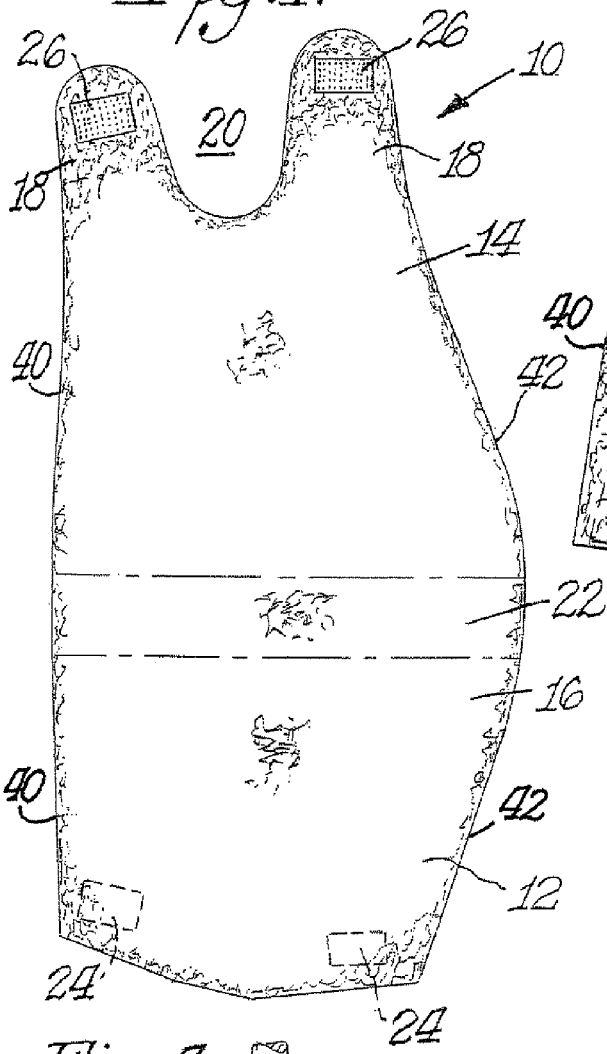
FIG. 1 is a top plan view of a cleaning attachment in accordance with one embodiment of this invention wherein the attachment is shown in its open unassembled condition.
Figure 2:
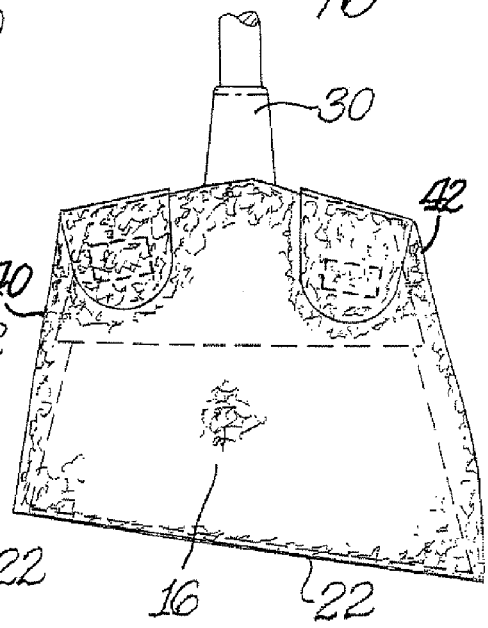
FIG. 2 is a side elevational view showing the attachment of FIG. 1 mounted on a broom.
Figure 3:
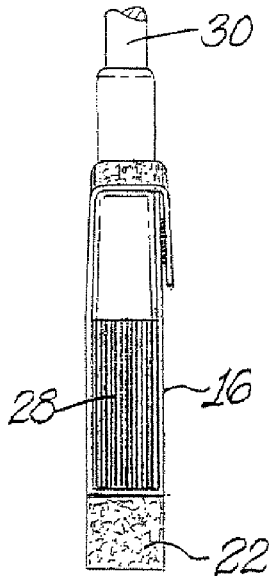
FIGS. 3 and 4 are end elevational views of the attachment shown in FIG. 2.
Figure 4:
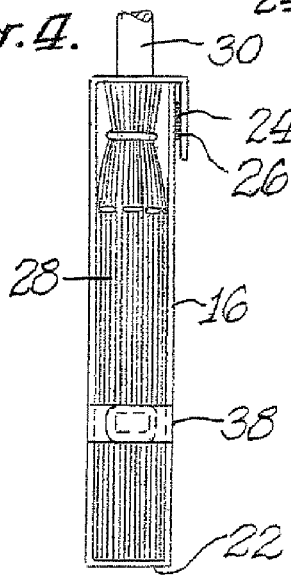

The above noted applications generally describe a cleaning attachment which includes a cover having a wipe detachably mounted to the bottom portion of the cover when the cover is mounted around the cleaning head of a cleaning implement. FIGS. 1-4 show a variation of the invention wherein the attachment 10 is actually a combination wipe and attachment. As shown therein attachment 10 is in the form of a flexible cover. FIG. 1 illustrates the cover in its flat unassembled condition to have a first end 12 and a second end 14 interconnected by a continuous intermediate section 16. The second end 14 is bifurcated to create a pair of spaced outwardly extending flaps 18,18 with an open space 20 between the flaps. Thus, as illustrated in FIG.1 the second end 14 terminates in a U-shaped outer edge to create the flaps which are spaced apart and out of contact with each other. The cover has an inner surface and an outer surface. The intermediate section includes a central section 22 between the first end 12 and the second end 14. Any suitable fastening structure 24 such as Velcro® loops or hooks is provided on the outer surface of the first end 12 while complementary fastening structure 26,26 is provided on the inner surface of the second end 14 and more particularly on the flaps 18 for engagement with the fastening structure 24 when the cover is mounted around the cleaning head 28 of a cleaning implement to form a closed loop around the cleaning head with the flaps being outwardly of and secured to the first end so that the open area 20 between the flaps permits the handle 30 of the cleaning implement to extend outwardly from the closed loop at the top of the loop. As shown in FIGS. 2-4 the central section 22 is at the bottom of the loop remote from the secured first end and flaps at the top of the loop.

The above description of the attachment 10 is generally similar to that described for various embodiments in the above noted applications. In those applications, however, the attachment further includes a wipe which would be detachably mounted generally at the bottom of the loop. Attachment 10 differs from those embodiments in that at least portions of the cover are made of an absorbent material to provide at least one contact portion on one side of the loop in the area of the central section so that the contact portion functions as the wipe. In the practice of the invention illustrated in FIGS. 1-4, the entire cover is made of absorbent material. A suitable absorbent material could, for example, be needle punch non-woven material. The absorbent material may be of such a structure that the material itself could inherently function as the loops for engagement with the hooks as the fastening structure preferably on the flaps so that it is not necessary to have separate and distinct complementary fastening structure in that the absorbent material, itself, could function as complementary fastening structure.

While the invention may be practiced where the entire cover is made of an absorbent material the invention may also be practiced where in addition to or instead of having the cover made entirely of absorbent material only a section or multiple sections could be made absorbent. Preferably, the invention would be practiced wherein there is a contact portion 17 on one side of the loop adjacent to or in the general location of the central section 22. The intermediate section 16 could have a second contact portion 17 on the opposite side of the loop in the vicinity of the central section. Both contact portions 17,17 could be made of absorbent material so that there is a cleaning area on each side of the loop at the bottom of the loop. As a result, one of the cleaning areas could be used for an initial cleaning while the other area could be used for wiping the cleaned area.

The invention could be practiced where dispensing structure is in at least one of the cleaning areas for dispensing an added ingredient. Where the entire cover is made of absorbent material the added ingredient can be impregnated throughout with the added ingredient to thereby comprise the dispensing structure.

Various types of added ingredients can be used such as an anti-stat, soil attractants, polymers which pick up and hold soil or applications for giving a wood floor a shiny appearance. Thus, such ingredients could include detergent cleaner, wood floor cleaner and shiner, one-step floor clean and shine, garage cleaner, etc.

Figure 5:
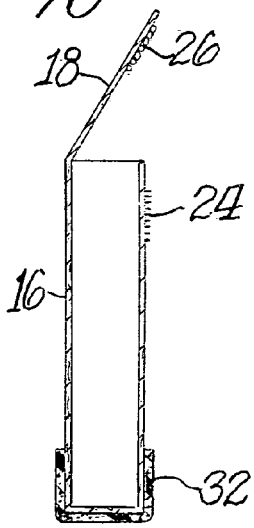
FIGS. 5-8 are side elevational views in section of variations of the attachment shown in FIGS. 1-4.

FIG. 5 shows a practice of the invention wherein the contact portions on each side of the cover are integral with the absorbent central section so as to form a single continuous cleaning area. This continuous cleaning area could be formed by having a pad 32 extend from one side of the loop to the other side through the central section as illustrated in FIG. 5. Such a pad could be a hydrophillic polyurethane foam coating on the bottom side of the cover. The foam coating could contain detergents, adhesives or other added ingredients.

Figure 6:
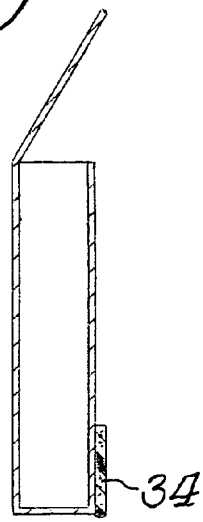

FIG. 6 shows a variation wherein the dispensing structure is a pad or foam coating 34 on only one side of the loop. The absorbent nature of at least the bottom portion of the opposite side of the loop would comprise a further cleaning area.

Figure 7:
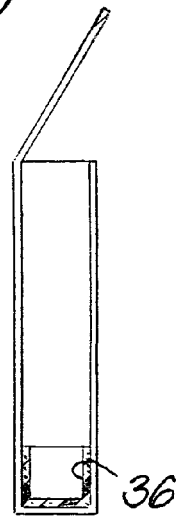

FIG. 7 shows a variation wherein the pad or coating 36 is mounted on the inside of the cover and would be dispensed through the porous absorbent cover material on both sides and the central section at the bottom of the loop. Such dispensing of the cleaning ingredients would occur when the bottom of the loop is wetted.

Figure 8:
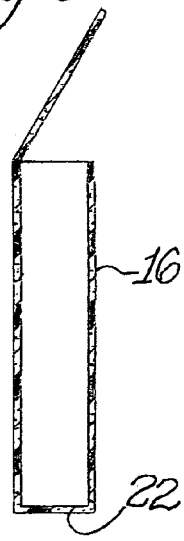

FIG. 8 shows the practice of the invention wherein it is the entire cover which is made absorbent such as being entirely made from needle punch non-woven material which could be impregnated with such added ingredients as cleaning ingredients, wood polish ingredients, etc. Where the dispensing structure is a pad, such as pads 32, 34 or 36 the pad could be detachably mounted to the cover. Alternatively, the pad could be permanently secured to the cover, particularly where the dispensing structure or pad is actually a coating.

FIG. 4 illustrates a further option in the various practices of the invention wherein the side edges of the intermediate section are provided with fastening structure such as belts, clips or flaps 38 to secure the loop together at at least one or multiple spaced locations between the upper and lower ends of the loop. Such extra side fastening structure would be particularly desirable where the attachment is used on relatively long cleaning heads, such as corn row brooms.

In the embodiment illustrated in FIGS. 1-4 the cleaning implement is a broom having a slanted bottom wherein one side of the broom cleaning head is longer than the other side of the broom cleaning head. In order to accommodate this structure of the cleaning head the cover has non-symmetrical outer edges for the intermediate portion wherein one of the edges 40, for example, would be relatively straight while the opposite edge 42 would be bowed outwardly. Thus, side edge 42 is longer than side edge 40. This results in the intermediate section 16 having two opposite sets of side edges with one of the sets of side edges 42,42 being longer than the other set of side edges 40,40 whereby the intermediate section is non-symmetrical in the unassembled condition, as shown in FIG. 1. When the attachment is in loop form, as shown in FIG. 2, the intermediate section 16 has a slanted central section 22 at the bottom of the loop to conform to the slanted shape of the cleaning implement. As a result of this non-symmetrical shape wherein the edge 42 is longer than the edge 40 a snug fitting of the attachment 10 results on the cleaning head 28.

Other variations of attachment 10 are also possible within the practice of this invention. As later described the dispensing structure could be a flexible pouch mounted to one of the sides of the loop with the pouch containing the added ingredient and with the pouch having a one-way valve in an outer wall to dispense the added ingredient when pressure is applied to the pouch. The pouch could be permanently or detachably mounted to the cover.

Figure 9:
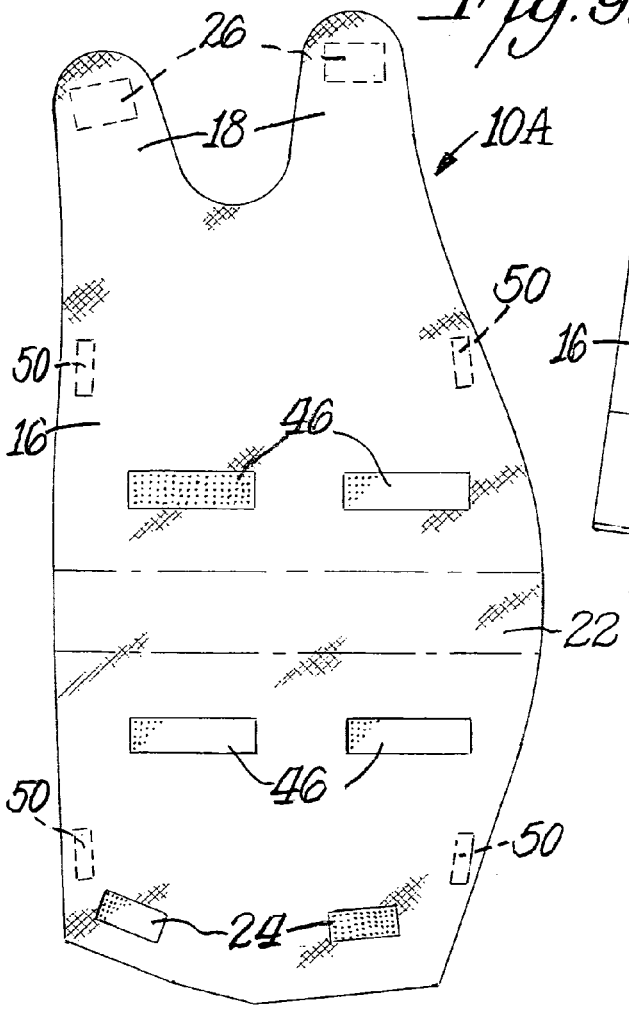
FIG. 9 is a top plan view of an attachment in accordance with a further embodiment of this invention.
Figure 10:
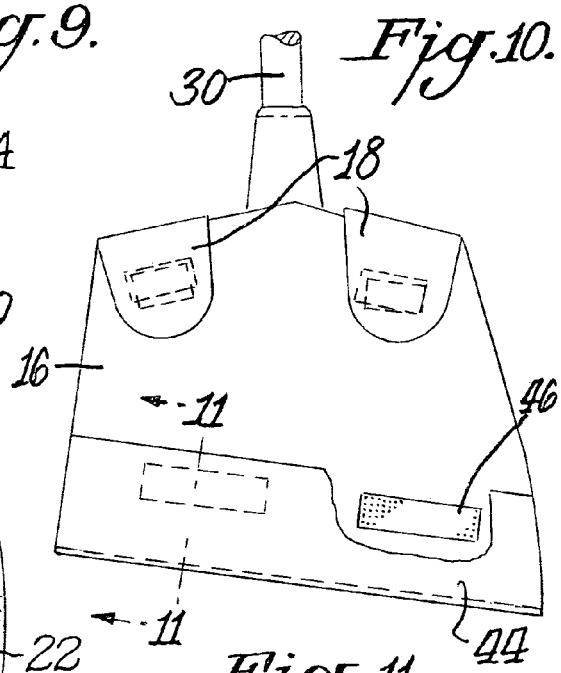
FIG. 10 is a side elevational view showing the attachment of FIG. 9 mounted on a broom.
Figure 11:
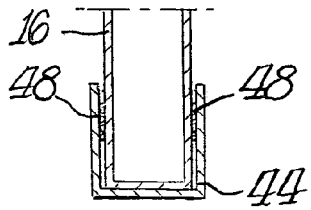
FIG. 11 is a cross-sectional view taken through FIG. 10 along the line 11-11.

FIGS. 9-11 show a further form of attachment 10A which is generally along the lines of the type of attachment described in the previously noted patent applications such as Ser. No. 09/917,069. Such attachment 10A could be symmetrically shaped as described in Ser. No. 09/917,069 to fit over a straight broom head or could have the non-symmetrical shape as illustrated in FIGS. 9-10 which would generally conform to the shape of attachment 10 for fitting over the cleaning head of a slanted broom. Accordingly, like reference numerals are used for like parts. Attachment 10A differs from attachment 10 in that attachment 10A is intended to have a wipe 44 detachably mounted preferably at the bottom of the loop formed when the cover is secured around the cleaning head of the cleaning implement such as illustrated in FIGS. 10-11. As illustrated the wipe 44 is detachably mounted to the cover through the use of sets of spaced reusable mounting structure 46 and further reusable mounting structure 46 located on at least one of the side walls formed by intermediate section 16. As illustrated, the reusable mounting structure is on spaced locations on each side of the central section 22. As a result, when the reusable mounting structure is engaged with complementary mounting structure 48 on the wipe 44 the wipe extends from one side of the loop around the central section 22 to the other side of the loop at the bottom of the loop remote from the secured first end and flaps 18 at the top of the loop.

The various embodiments of the invention may be practiced where the flaps are not integral with the remainder of the cover. Instead, for example, the flaps could be spanned straps or other fasteners which are secured across the tops of the first and second ends and spaced from each other to create the bifurcation with the separation between them.

The invention may be broadly practiced where the spaced sets of reusable and further reusable mounting structure are located on the same side wall in which case the wipe would be confined solely to that side wall. In a preferred practice of the invention, however, each of the first and second side walls includes the reusable mounting structure 46 so that the wipe would extend completely around the bottom of the loop. If desired, however, one set of reusable mounting structure could be on one side wall and the further reusable mounting structure could be on the central section so that the wipe extends down one side wall and terminates at the bottom of the loop at the central section without extending up the second side wall.

FIG. 9 illustrates a variation of the form of side attachment which is illustrated in FIG. 4. As shown in FIG. 9 instead of having bands or straps 38 secure the side edges of the cover together, the fastening structure could take other forms such as hooks and loops 50. The sets of fastening structure 50,50 on the two opposite side edges of the cover may be considered as supplemental fastening structure to secure the side edges together when the loop formed.

As with the attachment 10, the attachment 10A may also include a pouch which contains a cleaning solution or other added ingredients. Variations of such pouch or container are described with regard to FIGS. 15-18.

Figure 12:
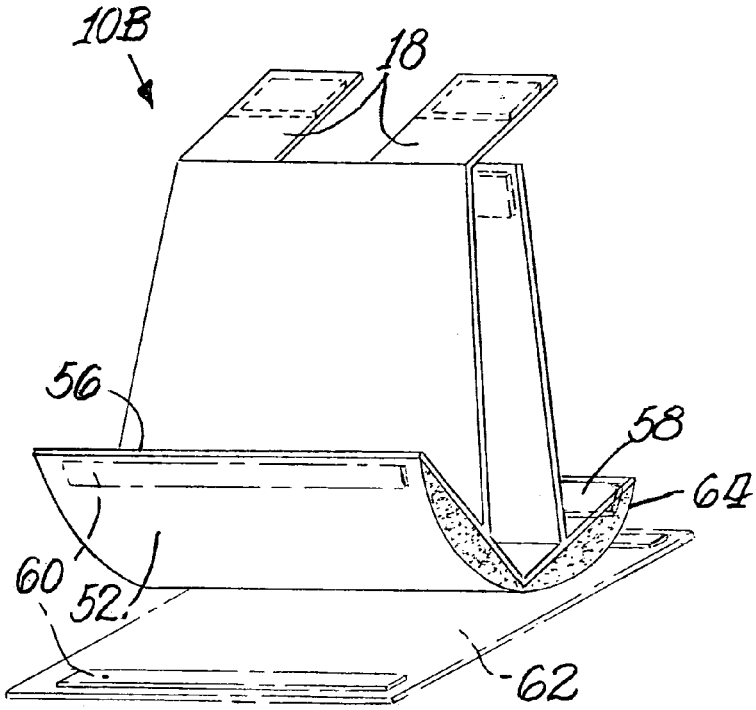
FIG. 12 is a perspective view showing yet another attachment in accordance with this invention.
Figure 13:
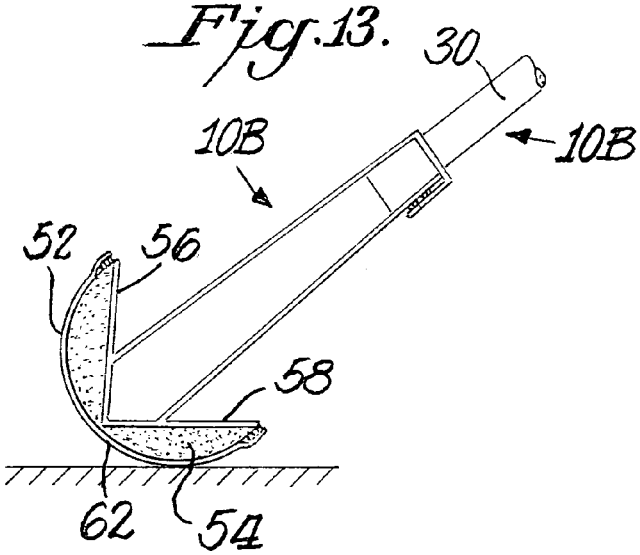
FIG. 13 is a side elevational view showing the attachment of FIG. 12 mounted on a broom.

FIGS. 12-13 illustrate yet another practice of this invention which may, but need not, include a dispensing system such as a cleaning solution tank. As shown in FIGS. 12-13 the outer cleaning surface of attachment 10C has a curved surface 52. The curved surface provides enhanced contact with the floor. This would result in superior cleaning ability for both dry mopping for dust and dirt or wet cleaning. The curved surface enhances the benefit of having dual sided cleaning cloths. The curved surface 52 can be achieved in any suitable manner. As illustrated in FIGS. 12-13 a single continuous or two separate foam pads 54 are attached to wings 56,58 to give the desired outer surface. Fasteners 60 are provided on outer surface 52 to mate with complementary fasteners 60 on wipe 62.

While FIGS. 12-13 illustrate the curved surface 52 to be achieved by foam material, the curvature could also be achieved by padding the outer surfaces of wings 56,58 with other materials including non-woven, rubber or other padding that could be sealed in during the manufacturing step. Pressure could be applied to these soft curved surfaces by pressing on the broom or other implement which would provide resiliency to the attachment wings 56,58. As illustrated the padded members 54 are covered by an outer layer or skin 64 of any suitable flexible material which could then be folded over and sewn or heat sealed to wings 56,58.

Where the outer skin 64 is porous one or both pads 54 may be impregnated with an added ingredient which would be dispensed through the porous outer skin.

Figure 14:
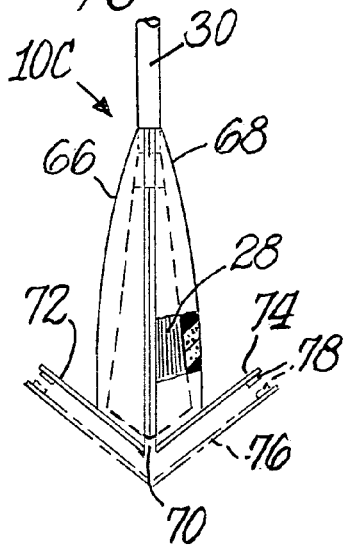
FIG. 14 is a side elevational view of yet another attachment in accordance with yet another attachment in accordance with still a further embodiment of this invention.

FIG. 14 shows yet another embodiment of this invention. This embodiment involves the manner of forming and mounting attachment 10C. In the previously described embodiments the attachment is mounted to the cleaning head by flaps which extend from one wall over the top of the cleaning head against the other wall. The flaps include fastening structure which mate with complementary fastening structure. In those practices of the invention the bottom portion of the attachment is of one piece permanently connected structure. FIG. 14 illustrates a variation where the attachment is of a clam shell type having the upper ends of walls 66 and 68 integral with each other, but including a central spacing to permit the handle 30 of the implement to be inserted through the spacing. The clam shell structure involves having the bottom portion of attachment 10C spaced from and movable away from each other instead of having an integral central support surface. In other words the central support surface is two sections separate from each other. Thus, FIG. 14 illustrates a gap 70 formed in the central support surface of attachment 10C so that the wings 72,74 can be moved away from each other to permit the attachment to be mounted over the cleaning head 28. The attachment 10C could be made of a plastic thermoformed unit that clamps around the implement cleaning head 28 and handle 30. The unit could then be maintained closed by any suitable structure such as by snap closures or Velcro® hook and loop formations. Once closed the wipe 76 would be mounted to wings 72 and 74. If desired, the fastening structure 78 on the wings and wipe could be used as a supplemental or as the sole manner of maintaining the clam shell attachment 10C in its closed condition.

It is to be understood that the invention could be practiced by incorporating features of one embodiment into other embodiments. Thus, for example, the embodiments of FIGS. 12-13 and 14 could include a cleaning solution container. Where appropriate the attachment could include only a single wing in various embodiments.

Figure 15:
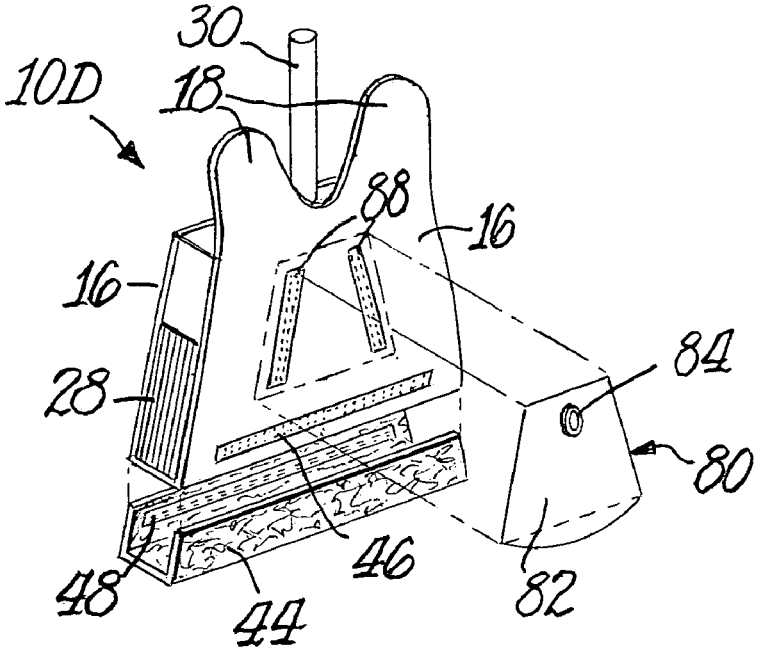
FIG. 15 is a perspective view of still yet a further attachment in accordance with this invention wherein a container would be detachably mounted to the attachment.
Figure 16:
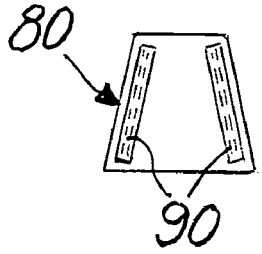
FIG. 16 is a side elevational view of a container that would be part of the attachment of FIG. 15.
Figure 17:
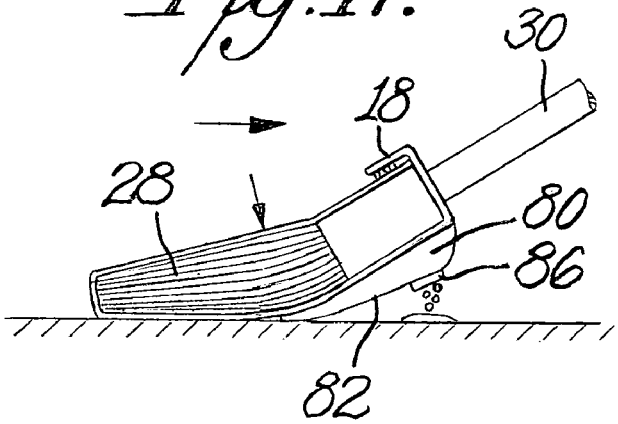
FIG. 17 is a side elevational view showing the attachment of FIG. 15 in use.
Figure 18:
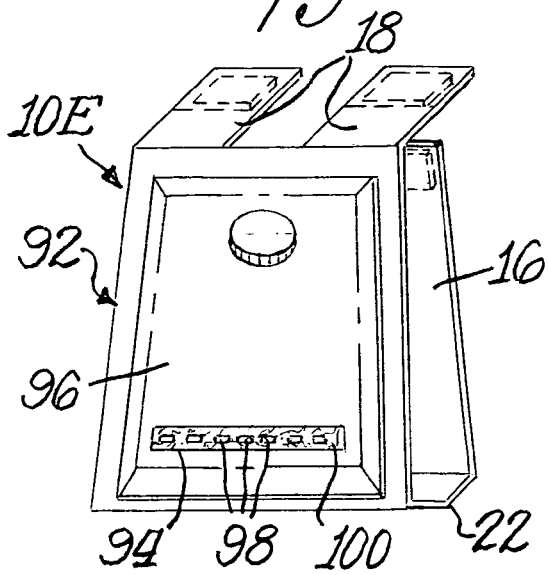
FIG. 18 is a perspective view of still yet a further attachment which is a variation of the attachment shown in FIGS. 15-17.

FIGS. 15-17 and also FIG. 18 illustrate a variation of the invention wherein a container or pouch may be mounted to any of the attachments in accordance with this invention. As shown in FIGS. 15-17 the attachment 10D includes a cover wherein at least one of the spaced side walls of intermediate portion 16 is provided with a container 80 for holding a cleaning solution. The container 80 has an outer wall 82 spaced from the cover. At least one dispensing opening 84 is in the outer wall. Flow regulating structure is provided at the dispensing opening 84 to selectively dispense the cleaning solution from the container. As illustrated in FIGS. 15 and 17 the flow regulating structure is a one-way valve located in the outer wall 82 which in turn is made of a flexible material. Thus when pressure is applied to the outer wall as illustrated in FIG. 17 the cleaning solution is dispensed through the one-way valve 86. Container or pouch 80 may be detachably mounted to the side wall formed by intermediate portion 16 through the use of any suitable fastening structure and complementary fastening structure 88,90, as illustrated in FIGS. 15 and 16 wherein the complementary fastening structure 90 is on the wall of portion of pouch 80 disposed against intermediate section 16. Such detachable containers or pouches 80 could be sold separately from the cover.

FIG. 18 shows a variation of the dispensing container 80. As shown therein, the attachment 10E could be of the generally described form wherein a cover includes flaps 18 so as to form a closed loop around the cleaning head of the cleaning implement. The container may be of generally the same construction as the various types of containers described in detail in application Ser. No. 10/180,409. In general, the container 92 is either permanently or detachably mounted to one of the side walls of intermediate section 16. Container 92 includes a bottom portion 94 in its outer wall 96. At least one and preferably a plurality of dispensing openings 98 are located in the bottom portion 94. The flow regulating structure is in the form of a sponge layer 100 mounted across the dispensing openings in the manner described in application Ser. No. 10/180,409.

Figure 19:
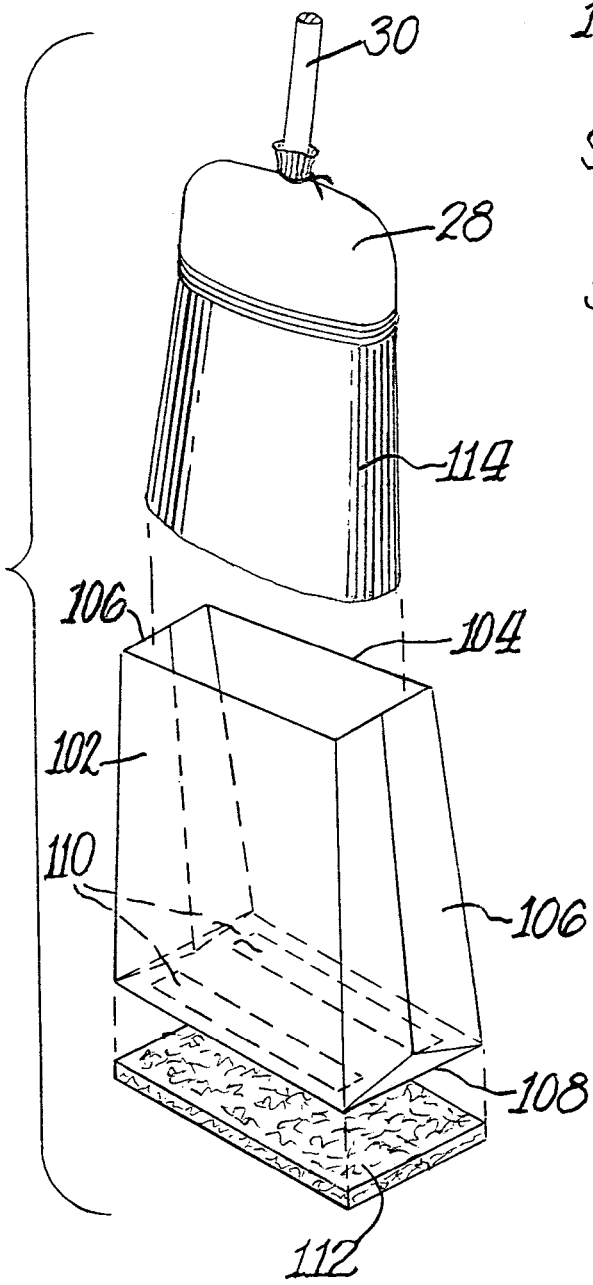
FIG. 19 is an assembly view of still yet a further attachment in accordance with this invention.
Figure 20:
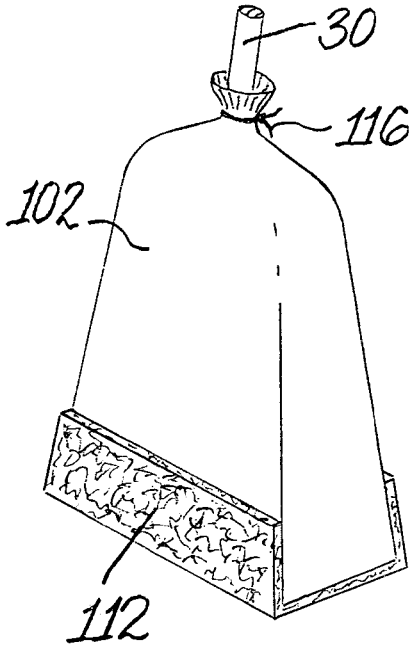
FIG. 20 is a perspective view showing a modified form of the attachment shown in FIG. 19 mounted on a broom.

FIGS. 19-20 illustrate yet another form of attachment which is generally in the form of a bag having side walls 102,104 and end walls 106,106 with an open top. The bottom wall 108 would correspond to the previously described central section 22. As shown in FIG. 19 bottom wall 108 could include reusable mounting structure 110 which could be in the form of a pair of Velcro® hook strips for engagement with wipe 112. Alternatively, the mounting structure could be on the side walls 102,104 so that the wipe 112 extends up the side walls as shown in FIG. 20. The bag could be loose fitting or dimensioned to be custom fit for broom head 28. In use the bag would be slid over the broom head 28 to completely cover the bristles 114 and broom head 28. The open end of the bag would then be secured to the broom head in any suitable manner such as by the use of a twist tie 116 which closes the bag around the handle 30. The attachment would be particularly useful with large size brooms. The attachment thus forms an enclosure which completely encloses the broom head. Although FIG. 20 illustrates the use of twist ties 116 as the fastening structure, other types of fastening members could be used including tie members integrally formed on the attachment.

The disposable bag or attachment of FIGS. 19-20 can be made entirely of materials consisting of non-woven, woven cloth, combinations, etc. and various plastic material, such as polyethylene, polypropylene, PET, etc. designed specifically for dusting floors, walls, etc. The use of the converted broom would provide the ability to reach high corners of a room to remove cobwebs. A user could dust, clean, remove the spiderwebs, etc. and then dispose of the attachment and removed material without much fuss and mess. In addition, the closed bag could contain water activated cleaning compositions that could be activated by moistening under tap water for damp brooming or damp mopping. If desired the central bottom section 108 could also be impregnated with activated cleaning compositions and then activated by moisture from tap water.

The attachment of FIGS. 19-20 is designed so that it has a flat, yet flexible bottom to match larger size disposable cleaning cloths in either wet or dry form. The flat bottom 108 allows the use of a larger surface area of hooks 110,110 to be applied for holding onto the disposable dusting or wet mopping cloths or wipes 112.

What is claimed is:

1. A combination wipe and attachment for converting a cleaning implement to a mop, comprising a flexible cover, said cover in its flat unassembled condition having a first end and a second end, a continuous intermediate section between said first end and said second end, said second end terminating in a U-shaped outer edge and being bifurcated to create a pair of spaced outwardly extending flaps with an open area of sufficient width between said flaps whereby said flaps are maintained completely spaced apart and out of contact with each other in both the assembled and the unassembled conditions of said cover, said cover having an inner surface and an outer surface, said intermediate section including a central section between said first end and said second end, fastening structure non-detachably on said inner surface of said flaps, complementary fastening structure non-detachably on said outer surface of said first end, said fastening structure and said complementary fastening structure being located for engagement when said cover is folded around a cleaning head of a cleaning implement to form a closed loop around the cleaning head with said flaps being outwardly of and secured to said first end whereby said open area between said flaps is adapted to accommodate a handle extending outwardly from the cleaning head, said loop having a top and a bottom, and said central section being at said bottom of said loop remote from said secured first end and flaps at said top of said loop, said intermediate section having a first contact portion on one side of said loop adjacent to said central section, said intermediate section having a second contact portion on an opposite side of said loop adjacent to said central section, each of said first contact portion and said second contact portion being made of absorbent material to provide a cleaning area on each side of said loop at said bottom of said loop whereby the mounting of said attachment to a cleaning implement converts the cleaning implement to a mop, said intermediate section having side edges whereby said loop has two opposite sets of side edges, and one of said sets of side edges being longer than the other of said sets of side edges whereby said central section is slanted to conform to a slanted shape of the cleaning implement.

2. The combination of claim 1 including dispensing structure in said cleaning area of at least one side of said loop for dispensing an added ingredient.

3. The combination of claim 2 wherein said central section is made of absorbent material whereby said contact portions are integral with each other to form a single continuos cleaning area, said dispensing structure being a pad mounted to said cover in said single continuous cleaning area, and said pad containing said added ingredient.

4. The combination of claim 3 wherein said pad is located against said inner surface within said loop with said cover disposed outwardly of said pad, and said pad extending from said one side of said loop to said opposite side of said loop across said central section.

5. The combination of claim 3 wherein said pad is located against said outer surface outside of said loop, and said pad extending from said one side of said loop to said opposite side of said loop across said central section.

6. The combination of claim 3 wherein said pad is located on said one side of said loop and does not extend to said opposite side of said loop with the combined thickness of said pad and said loop on said one side being greater than on said opposite side whereby said cleaning area on opposite side of said loop may function as a wipe.

7. The combination of claim 3 wherein said pad is a coating non-detachably mounted to said cover.

8. The combination of claim 2 wherein said dispensing structure is a flexible pouch mounted to one of said sides of said loop, said pouch containing said added ingredient, and said pouch having a one-way valve in an outer wall thereof to dispense said added ingredient when pressure is applied to said pouch.

9. The combination of claim 8 wherein said pouch is detachably mounted to said cover.

10. The combination of claim 1 wherein said intermediate section has side edges whereby said loop has two opposite sets of side edges, and each of said sets of side edges having supplemental fastening structure to secure said sets of said edges together.

11. The combination of claim 1 in further combination with a cleaning implement having a cleaning head and a handle, and said cover being mounted around said cleaning head with said handle extending outwardly from said cleaning head through said open area between said flaps.

12. The combination of claim 1 wherein said flaps and open area are confined to a terminal region of said second end which extends less than half the length of said second end, said first end having a pair of opposite side edges, said second end having a pair of opposite side edges disposed toward said side edges of said first end when said cover is in the form of a closed loop with said side edges being free of attachment to each other inwardly of the location of said flaps.

13. The combination of claim 1 wherein said first end and said second end are non-symmetrically shaped with respect to each other with said first end being continuous across its outer region free of flaps and free of an open area therebetween to differ from said second end having said flaps and open area therebetween.

14. The combination of claim 2 wherein said entire cover is made of said absorbent material to provide a single continuous cleaning area extending from said one side of said loop to said opposite side of said 1oop, and said cover being impregnated throughout with said added ingredient to comprise said dispensing structure.

15. A combination wipe and attachment for converting a cleaning implement to a mop, comprising a flexible cover, said cover in its flat unassembled condition having a first end and a second end, a continuous intermediate section between said first end and said second end, said second end being bifurcated to create a pair of spaced outwardly extending flaps with an open area between said flaps, said cover having an inner surface and an outer surface, said intermediate section including a central section between said first end and said second end, fastening structure on said inner surface of said flaps, complementary fastening structure on said outer surface of said first end, said fastening structure and said complementary fastening structure being located for engagement when said cover is folded around a cleaning head of a cleaning implement to form a closed loop around the cleaning head with said flaps being outwardly of and secured to said first end whereby said open area between said flaps is adapted to accommodate a handle extending outwardly from the cleaning head, said loop having a top and a bottom, and said central section being at said bottom of said loop remote from said secured first end and flaps at said top of said loop, said intermediate section having a first contact portion on one side of said loop adjacent to said central section, said intermediate section having a second contact portion on an opposite side of said loop adjacent to said central section, each of said first contact portion and said second contact portion being made of absorbent material to provide a cleaning area on each side of said loop at said bottom of said loop whereby the mounting of said attachment to a cleaning implement converts the cleaning implement to a mop, said intermediate section having side edges whereby said loop has two opposite sets of side edges, one of said sets of side edges being longer than the other of said sets of side edges whereby said bottom of said loop is slanted to conform to a slanted shape of the cleaning implement, and said side edges of said intermediate section being of non-symmetrical shape with respect to each other when said cover is in said unassembled condition.

16. The combination of claim 15 wherein said longer side edge is outwardly bulged and said other side edge is substantially straight.

17. A cleaning attachment for converting a cleaning implement to a mop, comprising a flexible cover, said cover in its flat unassembled condition having a first end and a second end, a continuous intermediate section between said first end and said second end, said second end terminating in a U-shaped outer edge and being bifurcated to create a pair of spaced outwardly extending flaps with an open area of sufficient width between said flaps whereby said flaps are maintained completely spaced apart and out of contact with each other in both the assembled and the unassembled conditions of said cover, said cover having an inner surface and an outer surface, said intermediate section including a central section between said first end and said second end, fastening structure non-detachably on said inner surface of said flaps, complementary fastening structure nondetachably on said outer surface of said first end, said fastening structure and said complementary fastening structure being located for engagement when said cover is folded around a cleaning head of a cleaning implement to form a closed loop around the cleaning head with said flaps being outwardly of and secured to said first end whereby said open area between said flaps is adapted to accommodate a handle extending outwardly from the cleaning head, said loop having a top and a bottom, said loop having first and second side walls formed by said intermediate section and separated from each other by said central section, reusable mounting structure on said outer surface on said first side wall and further reusable mounting structure on said outer surface of said cover, and said central section being at said bottom of said loop remote from said secured first end and flaps at said top of said loop with said reusable mounting structure and said further reusable mounting structure exposed at said outer surface to detachably mount a detached wipe at said first side wall of said loop to convert the cleaning implement to a mop and to detachably remove the wipe after use whereby a different non-detached wipe may be selectively mounted to said outer surface , said intermediate section having side edges whereby said loop has two opposite sets of side edges, and one of said sets of side edges being longer than the other of said sets of side edges whereby said central section is slanted to conform to a slanted shape of the cleaning implement.

18. The attachment of claim 17 wherein said further reusable mounting structure is on said first wall whereby a wipe may be mounted to said cover confined to said first wall.

19. The attachment of claim 17 wherein said further reusable mounting structure is on said central section whereby a wipe may be mounted to said cover on said first wall extending to said central section.

20. The attachment of claim 17 wherein said further reusable mounting structure is on said outer surface of said second wall whereby a wipe may be mounted to said cover to both of said walls and across said central section.

21. The attachment of claim 20 wherein a pouch is mounted to said first side wall above said reusable mounting structure, said pouch containing an added ingredient, said pouch having an outer wall remote from said cover, and said outer wall of said pouch having a one-way valve to dispense said added ingredient when pressure is applied to said pouch.

22. The attachment of claim 17 wherein a pouch is mounted to one of said side walls, said pouch containing an added ingredient, said pouch having an outer wall remote from said one of said side walls, and a one-way valve in said pouch outer wall to dispense said added ingredient when pressure is applied to said pouch.

23. The attachment of claim 22 wherein said pouch is detachably mounted to said cover.

24. The attachment of claim 17 wherein intermediate section has side edges whereby said loop has two opposite sets of side edges, and each of said sets of side edges having supplemental fastening structure to secure said sets of said edges together.

25. The attachment of claim 17 in combination with a wipe detachably mounted to said reusable mounting structure and to said further reusable mounting structure.

26. The attachment of claim 25 in further combination with a cleaning implement having a cleaning head and a handle, and said cover being mounted around said cleaning head with said handle extending outwardly from said cleaning head through said open area between said flaps.

27. The combination of claim 17 wherein said flaps and open area are confined to a terminal region of said second end which extends less than half the length of said second end, said first end having a pair of opposite side edges, said second end having a pair of opposite side edges disposed toward said side edges of said first end when said cover is in the form of a closed loop with said side edges being free of attachment to each other inwardly of the location of said flaps.

28. The combination of claim 17 wherein said first end and said second end are non-symmetrically shaped with respect to each other with said first end being continuous across its outer region free of flaps and free of an open area therebetween to differ from said second end having said flaps and open area therebetween.

* * * * *